United States Patent [19]

Ohtaki et al.

[11] 4,348,564

[45] Sep. 7, 1982

[54] SLIDE SWITCH

[75] Inventors: Shohei Ohtaki, Yokohama; Masanori Yamada, Yokosuka, both of Japan

[73] Assignee: Canon Kabushiki Kaisha, Tokyo, Japan

[21] Appl. No.: 196,438

[22] Filed: Oct. 14, 1980

[30] Foreign Application Priority Data

Oct. 17, 1979 [JP] Japan ..... 54-134460

[51] Int. Cl.[3] ..... H01H 13/28

[52] U.S. Cl. ..... 200/67 F; 200/33 R; 200/252

[58] Field of Search ..... 200/67 F, 252, 254, 200/330, 333, 16 R, 16 F, 17 A, 33 R

[56] References Cited

U.S. PATENT DOCUMENTS

| | | | |
|---|---|---|---|
| 3,209,097 | 9/1965 | Shlesinger | 200/67 F |
| 3,833,784 | 9/1974 | Bobel et al. | 200/330 |
| 3,857,000 | 12/1974 | Boulanger | 200/252 |
| 4,058,693 | 11/1977 | Schulz et al. | 200/67 F |
| 4,164,635 | 8/1979 | Finch et al. | 200/33 R |

*Primary Examiner*—Willis Little

*Attorney, Agent, or Firm*—Toren, McGeady & Stanger

[57] ABSTRACT

Disclosed is a slide switch in which a slide is slidable between a first position and a second position. A holding arrangement holds the slide in the second position when the slide has moved into the second position and permits the slide to return from the second position to the first position after a given lapse of time. A manually operable lever covering the slide serves to operate the slide. The lever is held at at least at one position and forms a recess sufficiently large to enable the slide to return from the second position to the first position.

11 Claims, 6 Drawing Figures

SLIDE SWITCH

BACKGROUND OF THE INVENTION

1. Field of the Invention

This invention relates to a slide switch, particularly one whose switch handle automatically returns to a predetermined position.

2. Description of the Prior Art

Recently, proposals have been made for slide switches which automatically return the switch handle to an initial position, in which it opens a circuit after a predetermined time in response to an output signal.

Such a switch would be advantageous as the main switch of a camera flash unit, where a photographer may overlook de-energizing the unit after use. However, because the switch handle of the switch normally projects beyond the surface of the unit, other devices loaded in the case with the unit, such as the camera, or lenses, may hinder the return operation of the unit to its initial position.

SUMMARY OF THE INVENTION

An object of the invention is to improve slide switches.

Another object of the invention is to avoid the aforementioned shortcomings.

Still another object of the invention is to provide a manually operable slide switch in which the switch handle can return to an initial position despite contact of the switch with other devices.

Another object of the present invention is to provide a manually operable slide switch of the aforementioned type for an electronic flash unit.

The various features of novelty characterizing the invention are pointed out in the claims. Other objects and advantages of the invention will be evident from the following detailed description when read in light of the accompanying drawings.

DESCRIPTION OF PREFERRED EMBODIMENTS

Figure 1:
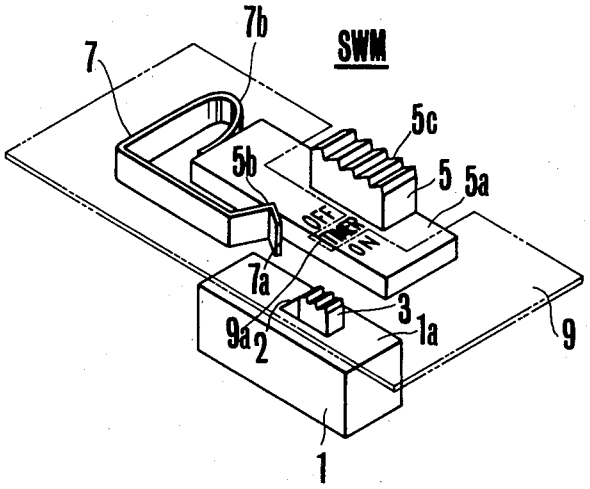
FIG. 1 is a disassembled perspective view of a flash unit slide-type power switch embodying features of the present invention.

In FIG. 1, a case 1 for the slide switch body forms a notch 2 which permits passage, with play, of a switch dial, knob or handle 3 movable between a first position (to be described) and a second position shown in FIG. 1. An operating lever 5 completely covers the handle 3 and carries a base plate 5*a* with legends "OFF" indicating that the power source switch SWM is in an OFF mode, "ON" indicating that the switch SWM is set in an ON mode, and "TIMER" indicating that the switch is set in a TIMER mode. The lower part of the base plate 5*a* carries a fixed guide (not shown in the drawing) to be inserted with play in the guide groove (not shown in the drawing) on the upper surface 1*a* of the case 1. The side surface of the base plate 5*a* is provided with a click groove 5*b* for engaging the bent part 7*a* of the spring 7 above. The above spring 7 in addition to the bent part 7*a* has a U-shaped part 7*b*, secured at a predetermined position on the case 1 by means not shown in the drawing. A light shading display plate 9 forms a display window 9*a* at the position opposite to the letters provided on the base plate 5*a*. A part of the display window 9*a* is 80 as removed so as to allow the free movement of the operating lever 5.

Figure 2:
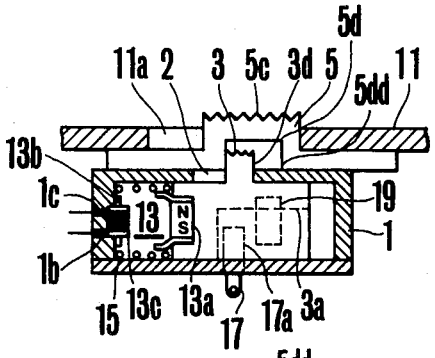
FIG. 2 is a sectional view of the power switch of FIG. 1.

FIG. 2 is a section showing the power source switch SWM in FIG. 1 mounted on the flash unit. In FIG. 2, a projection 5*c* of the operation lever 5 engages a notch 11*a* on the back cover 11 of the flash unit so that a part of projection 5*c* extends out of the surface of the back cover 11. Further, the lower surface of the operation lever 5 forms a concavity 5*d* sufficient to allow the knob 3 to move from the first position in FIG. 4 into the second position in FIG. 2 when the operation lever 5 assumes the neutral position (the aforementioned "TIMER" position). Inserted between the upper/surface of the lever 5 and the lower surface of the back cover 11 is the display plate 9 which is not shown in FIGS. 2 to 6.

A release type electromagnet 13 and a spring 15 are provided in the case 1. The magnet includes a permanent magnet 13*a* secured on a part of the switch knob 3 and a coil 13*c* wound on a yoke 13*b*. Wires of the coil 13*c* pass through holes 1*b* and 1*c* provided on the side surface of the case 1. A spring 15 pressed against the side surface of the case and the end surface of the knob 3, as is shown in the drawing, normally urges the handle 3 to the right. A contact member 17 secured on the lower part of the case possesses an extension 17*a* which projects into a concavity 3*a* of the handle 3. A movable contact member 19 secured on the concavity 3*a* of the handle 3 comes into contact with the stationary contact member 17 during translation of the handle 3 to the position shown in FIG. 4.

Figure 3:
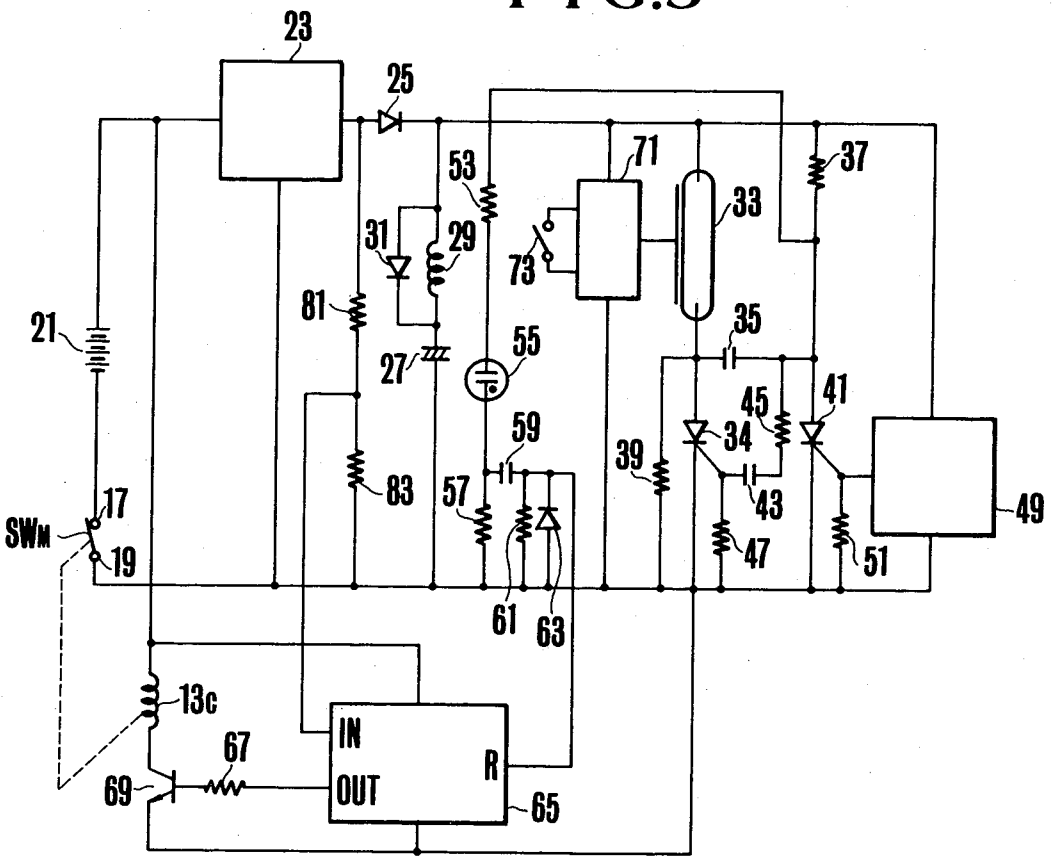
FIG. 3 is an electrical circuit for the flash unit associated with the switch of FIG. 1.

FIG. 3 shows an electrical circuit diagram for the flash unit shown in FIGS. 1 and 2. FIG. 3 includes a power source battery 21, a DC—DC converter 23, a rectifying diode 25, a main capacitor 27 connected to the cathode of the above-mentioned diode 25 through a coil 29 so as to store the flash energy, and a noise killing diode 37 connected in parallel to the coil 29. A conventional discharge tube 3 and a thyristor 34 are connected in series with each other to form a series circuit which is connected in parallel to a series circuit composed of the main capacitor and the coil 29. The circuit further includes a conventional commutating capacitor 35, resistors 37 and 39 forming a charge circuit for the capacitor 35, a subsidary thyristor 41 connected between the capacitor 35 and the main thyristor 34, a capacitor 43 connected to the capacitor 35 through the resistor 45 to control the conductivity of the main thyristor 34, a resistor 47 connected between the gate and the cathode of the main thyristor 34, a conventional control circuit 49 for sensing the light reflected from the object so as to deliver the flash stop signal when the amount of the sensed light has reached a certain determined value, a resistor 51 connected to the output terminal of the control circuit and in parallel between the gate and the cathode of the subsidiary thyristor 41, a resistor 53 connected to the diode 25 through the resistor 37, a resistor 57 connected to the resistor 53 through the conventional neon tube 55, a capacitor 59 and a resistor 61 for forming a differentiating circuit, and a diode 63 connected to the output terminal of the differentiating circuit so as to cut negative pulses a presettable counter 65 includes a reset pulse input terminal R for receiving the positive pulse produced in the differentiating circuit 59, 61 and an input terminal IN for receiving the oscillation pulse produced in the DC—DC converter 23 the base of a npn transistor 64 is connected to the output terminal OUT of the counter 65 through the resistor 67. Member 13*c* is the exciting coil in FIG. 2, 17 is the fixed contact piece in FIG. 2, 19 is the movable contact piece in FIG. 2. A conventional trigger circuit 71 for triggering the discharge tube is actuated by a trigger switch 73.

Figure 4:
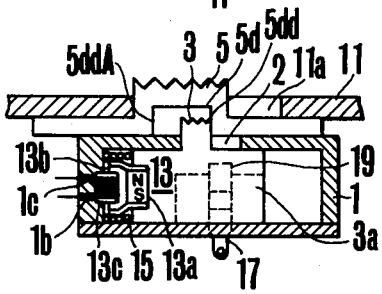
FIGS. 4 to 6 show the relationship between the elements of the power switch shown in FIG. 1 in each of its positions.

In operation when the operating lever 5 of the power source switch SWM in the position shown in FIG. 2 is manually moved to the left, the end surface 5*d* is brought into contact with the end surface 3*d* of the knob 3. When the lever 5 is moved further to the left against the force of the spring 15 until the permanent magnet 13*a* forming the armature of the magnet attracts the end surface of the yoke 13*b*, the movable contact member 19 is brought into contact with the fixed contact piece 17 as is shown in FIG. 4. The DC—DC converter 23 shown in FIG. 3 is now connected to the power source 21 through the power source switch SWM so as to start oscillating.

Figure 5:
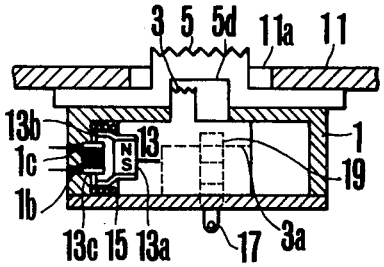

When the operation lever 5 is now freed, the U-shaped part 7*b* of the spring 7 shown in FIG. 1 urges the base plate 5*a* of the operation lever 5 to the right so as to automatically move the base plate 5*a* to the right. When the base plate 5*a* returns to the position at which the click groove 5*b* provided on the end surface of the base plate 5*a* opposes the bent part 7*a* of the spring 7, the bent part 7*a* enters the click groove 5*b* as is shown in FIG. 1. The slide motion of the base plate 5*a* and the operation lever 5 now stops. At this time the letters "TIMER" appears in the display window 9*a* so as to indicate that the TIMER mode has started. (The position at this time is shown in FIG. 5). When the DC—DC converters starts oscillating, the main capacitor 27 is charged through the diode 25 and the coil 29 and the terminal voltage of the capacitor 27 goes up rapidly. When the terminal voltage reaches a predetermined value, the neon tube is lit. Current runs through the resistor 57 through the resistors 37 and 53, and the neon tube 55, in such a manner that a positive pulse appears at the output terminal of the differentiating circuit 59, 61 so as to reset the content of the counter 65. After the reset, when an oscillation pulse is delivered to the input terminal IN from the DC—DC converter 23 through the voltage dividing circuit composed of the resistors 81 and 83, the counter starts counting again and the timer mode is established again.

After a lapse of a predetermined time, a flash photography is taken. The discharge tube 33 emits a flash, the control circuit 49 delivers a flash stop signal and the subsidary thyristor 41 assumes the conductive state. The charges in the capacitors 35 and 43 now discharged through the thyrister 41 so that the main thyristor 34 is reversed out of the conductive state into the non-conductive state. The discharge tube 33 now stops emitting light so as to terminate the flash photography.

On the other hand, when the thyrister 41 becomes conductive as mentioned, the neon tube 55 goes out to indicate that a flash photograph has properly been taken. Hereby, in case of the flash light photography that the above-mentioned flash stop signal is not produced from the control circuit 49, for example, in case the object is too far or in case the manual flash mode is set, the charge of the capacitors 35 and 43 is also completely discharged, so that also in this case the above-mentioned neon tube 55 is put out.

When the flash unit is loaded and the power source switch SWM remains closed after termination of the flash light photography, the DC—DC converter 23 continues the oscillation because the power source switch SWM is in the TIMER mode as is shown in FIG. 5. Hence the counter continues to count the oscillation pulses. Although the counter 65 is reset when the neon tube 55 is lit, the counter 65 continues counting the oscillation pulse because the power source switch SWM remains in the TIMER mode after the neon tube 55 is lit.

Figure 6:
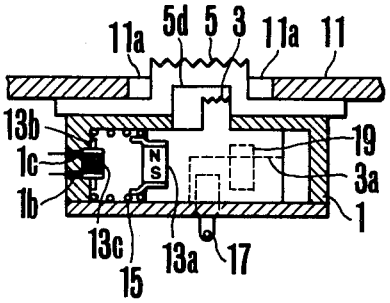

When the level at the output terminal of the timer circuit turns high after the lapse of a time preset on the counter 65, the transistor 69 at the output terminal of the timer circuit becomes conductive and the exciting current runs through the coil 13*c* of the magnet 13. This releases the yoke 13*b* from the armature 13*a* shown in FIG. 2. Thus, the force of the spring 15 moves the switch knob 3 of the strength to the right within the case 1 until the end surface 3*d* contacts the end surface 5*dd* of the concave part 5*d* of the operation lever 5 as is shown in FIG. 6. The knob 3 then stops moving. When the switch knob 3 is moved into the position shown in FIG. 6, the contact of the movable contact member 19 with the fixed contact member 17 is discontinued, so that the current supply to the circuit of the flash unit and the driving circuit for the coil 13*c* is interrupted.

On the other hand, although the switch knob 3 is automatically moved toward the initial position in the concave part 5*d* of the operation lever 5 as explained, the word "TIMER" remains displayed in the display window shown in FIG. 1 because the operating lever 5 is kept at the position as shown in FIG. 1, the bent part 7*a* of the spring 7 being engaged in the click groove 5*b*.

When the operating lever 5 is forced out of the position shown in FIG. 5 to the position shown in FIG. 2 while the power switch SWM is in the TIMER mode, namely in the condition shown in FIG. 5, the movable contact member 9 is released from the fixed contact member 17. This occurs because the end surface 5*dd*A of the concave portion 5*d* of the operating lever 5 slides the switch handle 3 into the position shown in FIG. 2. This interrupts the current supply to the power source.

As explained, in accordance with the present invention, the freedom of the movement of the switch knob is guaranteed by virtue of the space in the concave part or recess of the operating levers at the neutral position. Hence, even if something lies on the operating lever or the operating lever is in contact with something such as the camera, the switch knob can be automatically moved without being influenced thereby. This is quite advantageous.

Using the DC-DC converter as the oscillation source of the counter as is shown in FIG. 3, makes possible a flash unit of simple construction. Also, constructing the counter as is shown in FIG. 3, to be reset to a desired level when the main capacitor has been charged, causes the time formed with the counter to be unusually precise because the counter counts the oscillation pulses after the oscillation of the DC-DC counter is stabilized.

What is claimed is:

1. A slide switch comprising:

(a) sliding means slidable between a first position and a second position;

(b) holding means for releasably holding the sliding means in the second position when the sliding means assumes the second position and automatically enabling the sliding means to return from the second position to the first position after the lapse of a predetermined time; and (c) a manually operable lever over the sliding means to cover the sliding means and coupled with the sliding means to operate the sliding means; said lever being held at least at one position and having a recess sufficient for enabling the sliding means to return from the second position to the first position when the sliding means has been held at the second position.

2. A slide switch according to claim 1, wherein the lever includes a wall at the recess and the sliding means includes a projection movable by the wall at the recess of the lever.

3. A slide switch according to claim 1, wherein the lever consists of hard material.

4. A slide switch according to claim 1, wherein the holding means includes a spring in contact with the sliding means in order to return the sliding means from the second position to the first position.

5. A slide switch according to claim 4, wherein the holding means includes a magnet for attracting the sliding means toward the second position against the force of the spring.

6. A slide switch for an electronic flash unit device, comprising:

(a) sliding means slidable between a first position and the second position;

(b) holding means for holding the sliding means in the second position when the sliding means has moved into the second position and enabling the sliding means to return from the second position to the first position after lapse of a predetermined time;

(c) a manually operable lever positioned over the sliding means to cover the sliding means and coupled with the sliding means to operate the sliding means, said lever being held at least at one position and having a recess sufficient for enabling the sliding means to return from the second position to the first position when the sliding means has been held at the one position; and (d) a pair of contact members in the power line of the flash device, said members being located at positions at which they contact each other when the sliding means has been moved into the second position.

7. A slide switch according to claim 6, wherein at least one of the contact members is secured on a part of the sliding means.

8. A slide switch according to claim 7, wherein the lever includes a wall at the recess and the sliding means includes a projection movable by the wall at the recess of the lever.

9. A slide switch according to claim 7, wherein the lever consists of hard material.

10. A slide switch according to claim 7, wherein the holding means includes a spring in contact with the sliding means to return the sliding means from the second position to the first position.

11. A slide switch according to claim 7, wherein the holding means includes a magnet for attracting the sliding means toward the second position against the force of the spring.

* * * * *